US008622053B2

(12) United States Patent
Nowak et al.

(10) Patent No.: US 8,622,053 B2
(45) Date of Patent: Jan. 7, 2014

(54) BURNER AND METHOD OF ITS OPERATION

(75) Inventors: Miroslaw Nowak, Bydgoszcz (PL); Dariusz Krywalski, Solec Kujawski (PL)

(73) Assignee: Planika Sp. z o.o., Brzoza (PL)

( * ) Notice: Subject to any disclaimer, the term of this patent is extended or adjusted under 35 U.S.C. 154(b) by 633 days.

(21) Appl. No.: 12/661,298

(22) Filed: Mar. 15, 2010

(65) Prior Publication Data

US 2011/0171587 A1 Jul. 14, 2011

(30) Foreign Application Priority Data

Mar. 16, 2009 (PL) ..... 387513
Oct. 29, 2009 (PL) ..... 389408

(51) Int. Cl.
*F24C 5/02* (2006.01)

(52) U.S. Cl.
USPC ..... 126/44; 126/43; 126/350.2; 431/331

(58) Field of Classification Search
USPC ..... 126/42, 43, 44, 95, 350.2; 431/331
See application file for complete search history.

(56) References Cited

U.S. PATENT DOCUMENTS 354,300 A * 12/1886 Belden ..... 431/225
407,632 A * 7/1889 Belden ..... 431/244
1,438,314 A * 12/1922 Kornfeld ..... 431/105
2,905,800 A * 9/1959 Gochoel ..... 392/395
3,576,382 A * 4/1971 Finnstrand ..... 431/208
4,582,478 A 4/1986 Hilker
5,033,956 A * 7/1991 Nystrom ..... 431/11
5,033,957 A * 7/1991 Gerstmann et al. ..... 431/123
5,066,219 A * 11/1991 Anzawa et al. ..... 431/10
5,218,952 A * 6/1993 Neufeldt ..... 126/92 AC
5,474,442 A * 12/1995 Gertsmann et al. ..... 431/119
2010/0192937 A1 * 8/2010 Vacca et al. ..... 126/263.01

FOREIGN PATENT DOCUMENTS

EP 2028420 2/2009
GB 330737 6/1930
JP 56059103 A * 5/1981 ..... F23D 3/14
PL 153590 12/1989
PL 153434 3/1990
PL 288224 12/1991
PL 96170 7/1993
PL 375121 11/2006
WO 2009049047 4/2009

* cited by examiner

*Primary Examiner* — Kenneth Rinehart
*Assistant Examiner* — Jorge Pereiro
(74) *Attorney, Agent, or Firm* — Horst M. Kasper

(57) ABSTRACT

A liquid fuel-fired furnace installation is composed of at least one fuel tank (1), a fuel evaporation plate (2), a fuel vapor distribution plate (3) and a valve cutting-off the vapor flow, whereas the fuel tank (1) is connected with an evaporation plate (2) via a conduit (7), and the evaporation plate (2) is equipped with a vapor outlet (8) connected with a cut-off valve (4) and a vapor distribution plate (3) is connected with an inlet stub pipe (11), and in its upper part the plate has holes (12) though which the fuel vapors are exhausted. The installation is characterized by having fuel (P) delivered gravitationally via the conduit (7) into the evaporation plate (2) according to the connected vessels rule, which assures that an aerial layer is left over the fuel table (13).

7 Claims, 7 Drawing Sheets

BURNER AND METHOD OF ITS OPERATION

Figure 1:
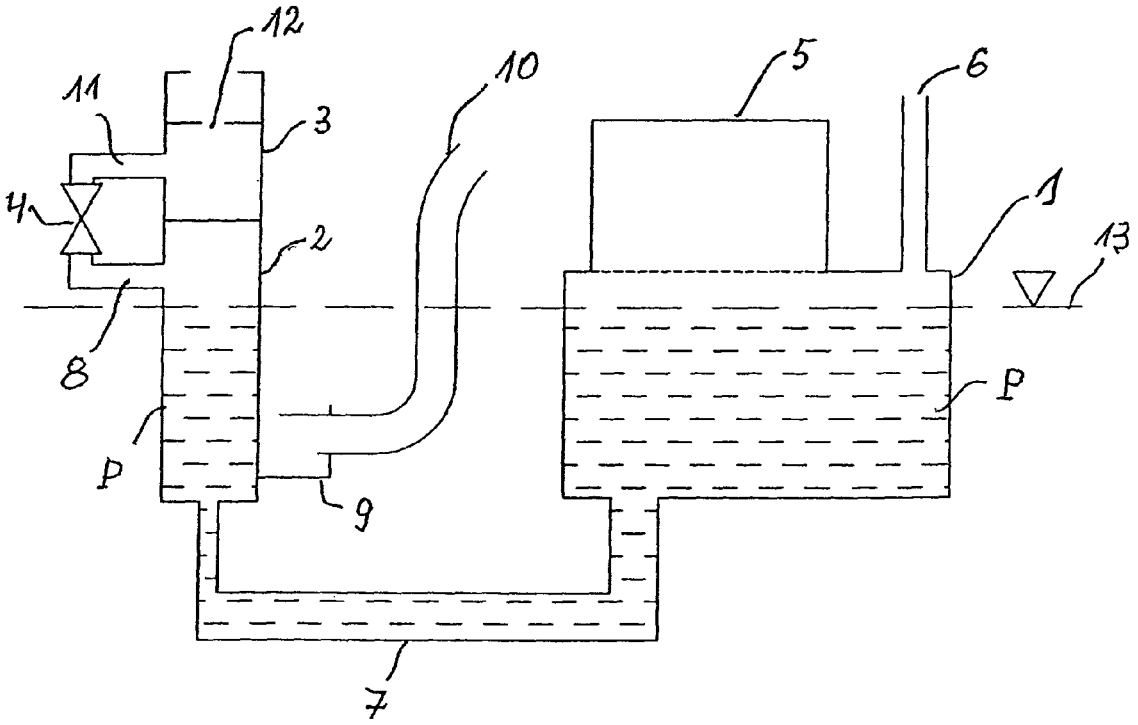

The invention in question refers to a liquid fuel-fired furnace installation, including its functional description. The liquid fuel in form of ecologic alcohol is combusted in the furnace installation, fireplace for example, emitting heat, which is used for compartment heating. Moreover, the furnace installation can be used for decorative purposes in various types of public compartments.

Bio-fireplace furnace installation according to Polish patent application P 385294, in which the furnace installation consists of two basal parts, accumulative container and radiator chamber in form of a tailored in shape cover, is already commonly known. The container is mounted in an additional vessel, whereas its part with the radiator chambers is shape tailored to the container shape with suitably shaped chambers in form of semicircular open vessels in the upper part. The presented furnace installation and its functional description does not satisfy conditions of the newest rigorous regulations with respect to the use of liquid fuel furnace installations, in which the fuel is located near the furnace, being combusted in the open area over the furnace installation. Moreover, the presented furnace installation does not assure a possibility of its cubic capacity increase with respect to the delivered liquid fuel, what can result in a filling frequency reduction, precluding immediate quenching. Commonly known furnace installations are also sensitive to air blasts and they heat up the fuel containers. A number of improvements was introduced in the solution of furnace installation from patent description EP 2028420 A1. However, mode of the liquid fuel combustion is based on the rule that combustion of fluid delivered via pipe into a furnace installation takes place in result of combustion of combustible gases over the furnace installation surface. Such manner of the liquid fuel combustion requires use of complex control systems, including combustion process control. Another disadvantage of this solution is a lack of a possibility of automatic fuel ignition from an electric spark, if the ambient temperature is lower than 15° C., as the phenomenon of suitable fuel evaporation allowing a vapor concentration needed for ignition from the electric is not observed.

The invention presented here is aimed at a construction of the furnace installation eliminating the mentioned disadvantages. Its principle of operation would be based on different rule with respect to liquid fuel combustion manner, whereas the new principle should allow the furnace installation cubic capacity increase in case of disposable amount of delivered fuel, as well as with respect to the installation operational safety.

In case of the new furnace installation, the basic task was realized in such manner that, according to the invention essential features, the installation consists of at least one fuel tank, a fuel evaporation plate, a fuel vapor distribution plate and a fuel flow cut-off valve, whereas the fuel tank is connected via a conduit with the fuel evaporation plate, which is equipped with a vapor outlet connected with a cut-off valve. It is also equipped with an externally mounted heating plate with a fuel light up inlet, whereas the vapor distribution plate is connected to the inlet connector and having holes in an upper part for vapor exhaust.

Moreover, the furnace installation, according to significant invention features, is characterized by a fuel tank equipped with fuel inlet and vent pipe.

In an advantageous option, the furnace installation is equipped with two fuel tanks, positioned in parallel, and connected via a pipe conduit. Evaporation plate and distribution plate are located between the fuel tanks. The main tank located near the fuel inlet used for firing up is equipped with a metering pump, and a firing up trough with a wick located under the fuel inlet. All mentioned components are closed in a housing equipped with ventilation slots.

In another option, a furnace installation adapted for remote electronic control, is characterized by a set of heaters replacing the heating plate and electric valve and distribution plate temperature sensors and an evaporation plate temperature sensor, as well as automatic spark ignition and a set of safety sensors, including movement sensor, carbon oxide or optional carbon dioxide sensor, humidity sensor, are installed in the control system, whereas the fuel inlet in the main tank is protected with a mobile cover connected with a switch disabling the installation when the cover is open.

In an aspect of the principle of operation, the invention characteristic feature is that only fuel vapors are combusted in the furnace installation. The liquid fuel delivered into the combustion chamber is previously heated up in a heating chamber up to a selected temperature, until obtaining vapors, which in result of generated pressure are transferred into the combustion zone being the surface of an optionally shaped distribution chamber with numerous holes. Vapors get out via these holes and after ignition they are exposed to a controlled combustion process.

A next essential operational feature of the furnace installation is that the fuel is delivered to the evaporation plate in a gravitational manner, due to the connected vessels principle. The fuel is delivered in such manner that an aerial layer is left over the fuel table, which protects the fuel against entry into the valve and then into the fuel inlet. A small amount of fuel is metered for the ignition. The fuel is ignited in the heating plate what results in a fast heating of the evaporation plate together with the fuel, and the generated fuel vapors, under the influence of vaporization and raised pressure are transferred into the valve, and via an inlet connection into the distribution plate, where they are propagated and then exhausted via plate holes over the plate along its whole length. Then, after fuel depletion in the heating plate, the fuel vapors combusted over the distribution plate heat up the plate and its heat is transferred onto an evaporation stimulating process of fuel combustion on a targeted level in a self-acting manner, up to the moment of fuel depletion in the tank.

Moreover, the principle of operation of the furnace installation is characterized by this that the flame extinguishing or stoppage of the fuel vapor combustion process is obtained as a result of cut-off valve closing.

Other essential advantage of the furnace installation in automatic option is that the furnace installation is electronically controlled with use of a pilot, allowing automatic spark ignition, whereas after the installation is set working, the furnace installation is self-controlled with respect to combustion parameters, detecting unwanted concentration of generated gases, system leakage, and improper transport (overturning, conveying).

The furnace installation and its principle of operation possess a number of advantageous technical and usable features, as compared with commonly known furnace installations used as fireplaces and heating decorative devices.

According to essential features of the invention, the installation constitutes considerable technical development as compared with commonly known furnace installations, for example applied in bio-fuel bio-fireplaces. The advantages comprise as follow:

1. as compared to the standard installations, the fuel load in enlarged, and cubic capacity of fuel tanks is limited only by the product size. In solutions known so far, the fuel volume was limited with respect to surface vapor combustion manner. So far, combustion on the liquid surface caused heating of the whole liquid volume, what resulted in the liquid boiling in its whole volume, and the flame was no longer controlled. In the present solution, vaporization takes place within a precisely controlled small volume, and the fuel in tanks is not heated up, and only a small amount of fuel is heated up in the evaporation chamber, 2. immediate flame extinguishing takes place as vapor delivery is stopped, instead of the oxygen delivery for combustion. In former solutions, flame extinguishing resulted from cutting-off the air delivery to the fuel surface, what not always assured the flame extinguishing because of leakages and generated vapors. Additionally, after the furnace extinguishing, the fuel was evaporated for a long time period because of the raised temperature. Thanks to a tight vapor cut-off, in the proposed solution, evaporation is no longer observed.
3. the described device is characterized by a uniform operation, i.e. the device generates a defined amount of vapors allowing formation of a desired flame size. The amount of heat taken from the flame for vaporization of the next fuel amount/portion is relatively constant, and the flame has a constant size during operation. Thanks to selection of a suitable material, a thickness of the walls and their geometry, the amount of heat needed to evaporate the fuel is sufficient for combustion to be kept on a constant level.
4. an insensitiveness to blasts of air directed into the furnace installation. The furnace installation, used so far, possesses a disadvantage in the form of rapidly dislocated vapor masses. Furnace installations in which combustion of the fluid surface takes place together with a fuel reduction and a raise of its temperature generate larger amount of vapors than during initial operation. The space over the fluid is filled with vapors, and an air blast directed toward the furnace installation pushes the vapors outside, where they are mixed with air creating a combustible mixture. That results in the formation of a "fire sphere" much greater than a standard furnace flame. In the presented solution, according to the essential invention features, the amount of vapors produced in time is the same, and their influence takes place through a train of holes. An air blast directed toward the furnace installation results in a flame quenching but not in pushing out of great amounts of vapors. Thanks to that the installation is safer than commonly known solutions.
5. thanks to a selection of a suitable material of a known thermal conductivity, as well and thanks to a matching of the amount of vaporized fuel to the thickness of the walls, as well as the wall arrangement, a stabile constant flame was obtained, whereas a flame enlargement is not possible without an additional heat source because the system, as stabilized, is working continuously with the same heat circulation.
6. an additional advantage of the new combustion mode application, particularly in devices of liquid fuel-fired fireplaces comprises the possibility of an optional flame line formation, which can be oblique, arc-shaped or wavy. Former known solutions allowed formation of only parallel to the base disposed straight lines. A next advantage is a lack of necessity of long anticipation for the furnace installation cooling down before re-starting. Possibility of ignition with electric spark, even if the room temperature drops below 15° is also an advantageous feature of the new solution.

Figure 2:
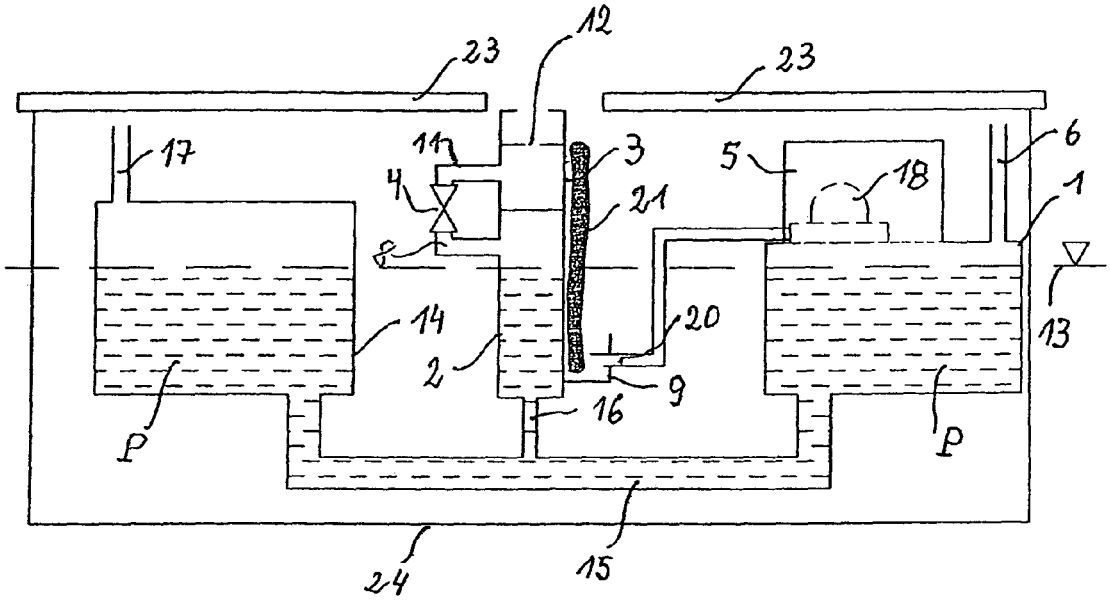
Figure 3:
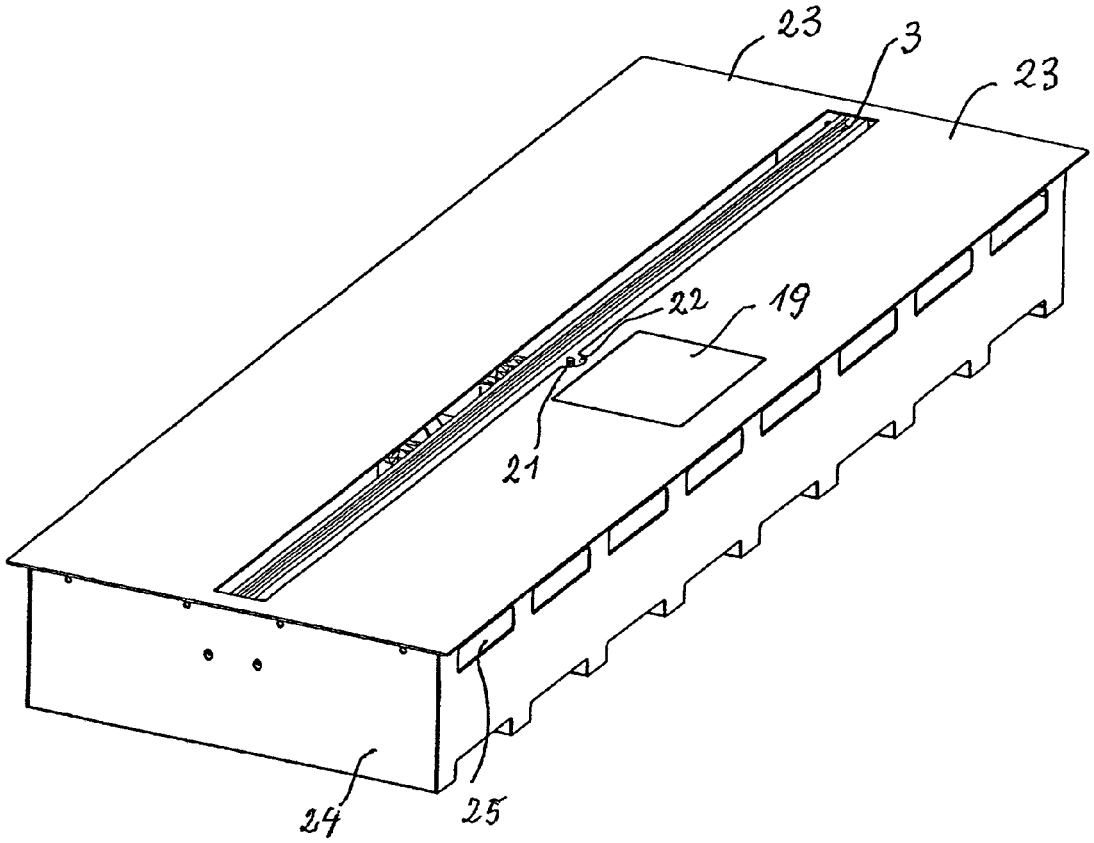
Figure 4:
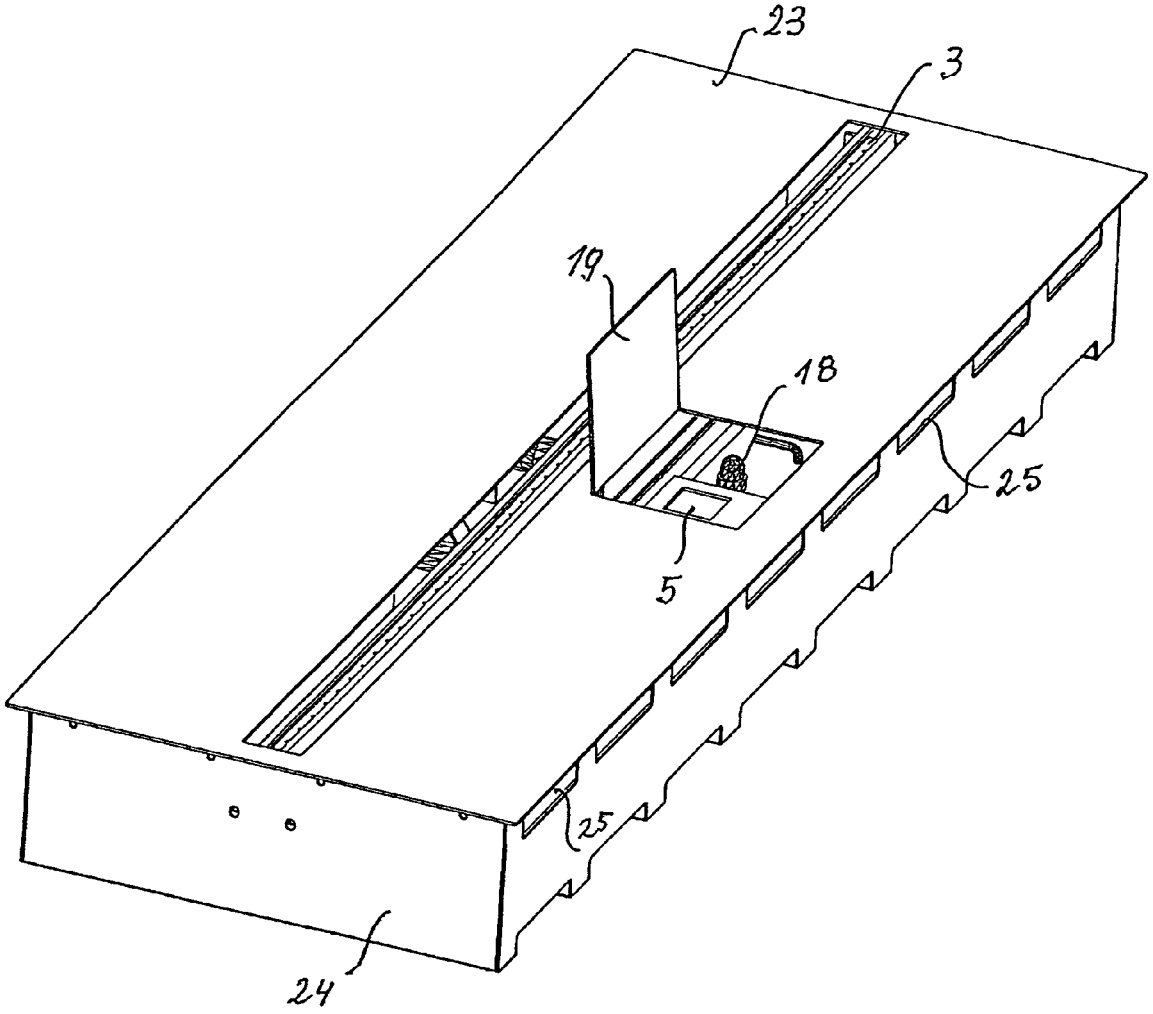
Figure 5:
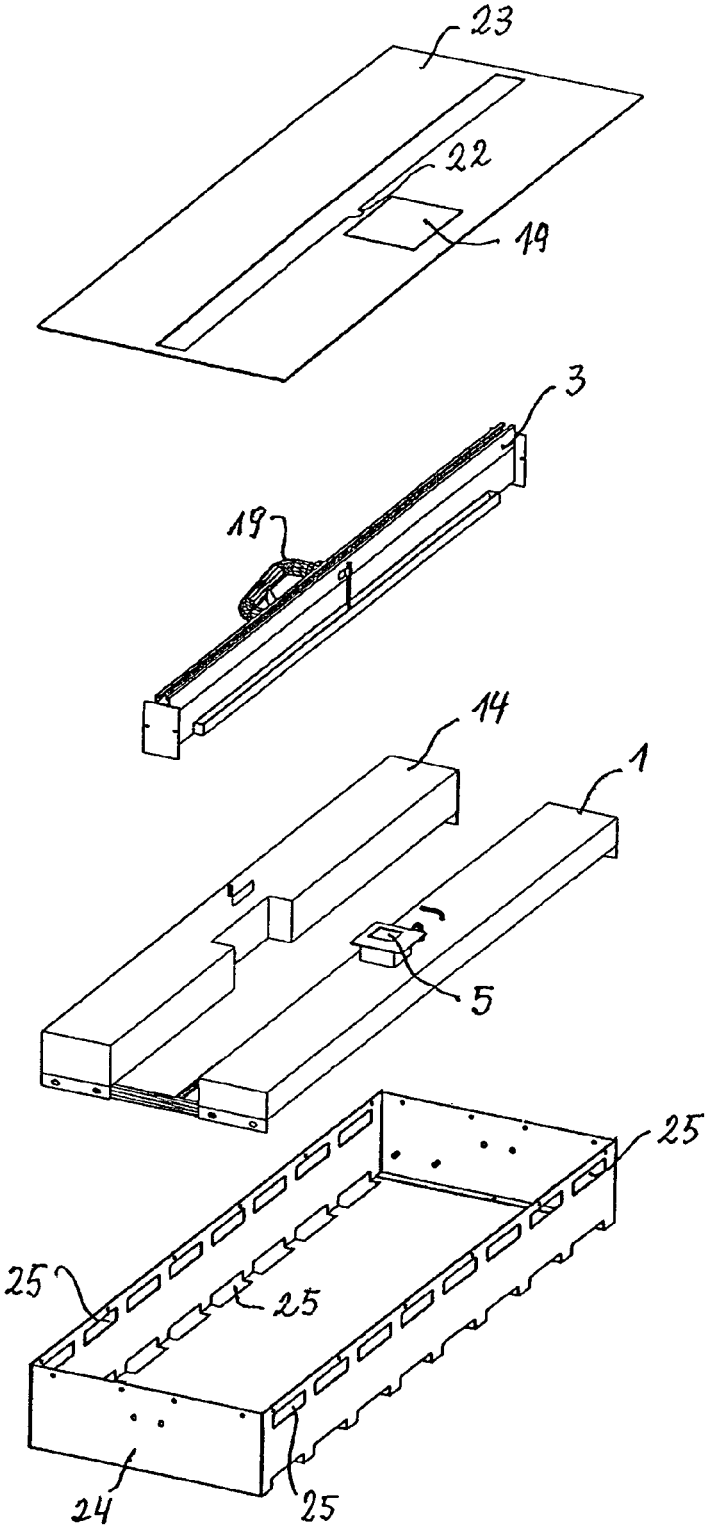
Figure 6:
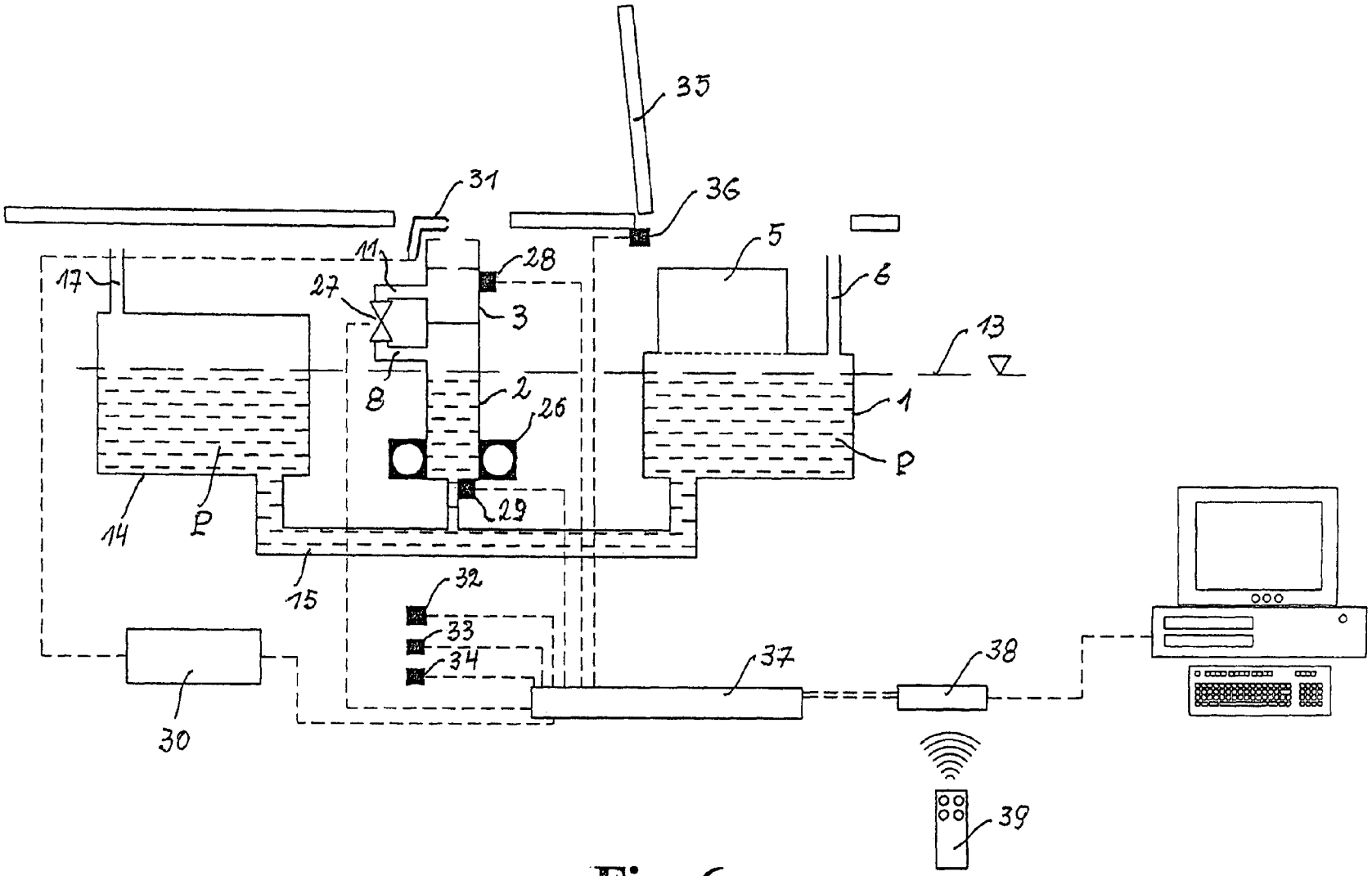
Figure 7:
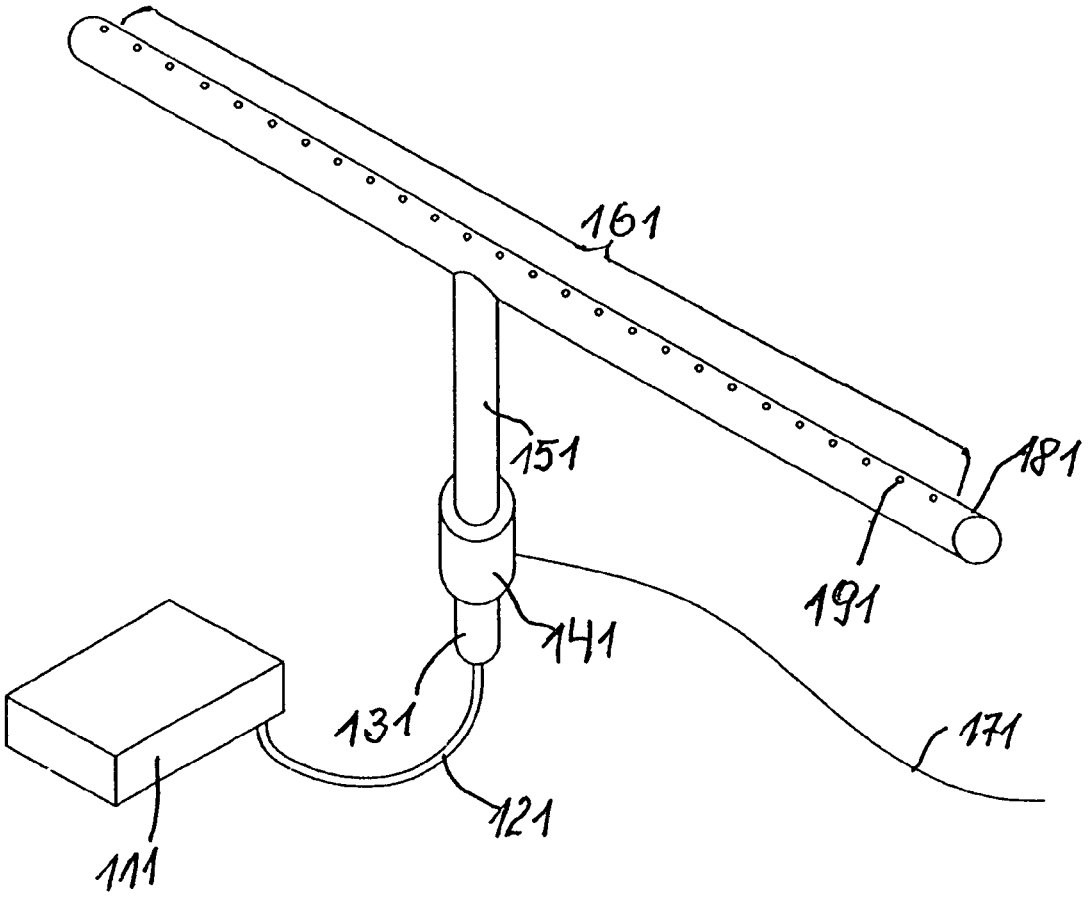

An example of a useful application of essential features of the invention is shown in the attached figure, where:

FIG. 1—is a schematic view of the furnace installation system with a single fuel tank, FIG. 2—is a schematic view of the furnace installation system with two fuel tanks in the shield, FIG. 3—is a view of the complete furnace installation—in a perspective projection, FIG. 4—is a view of a complete furnace installation with an open fuel inlet—in a perspective projection, FIG. 5—is a view of the furnace installation from FIGS. 3 and 4—in a perspective projection of subassemblies, FIG. 6—is a schematic view of the furnace installation system—for an automatic option, FIG. 7—is a schematic view of the combustion—in a furnace installation with a single fuel tank.

A furnace installation in an option with a single fuel tank is composed of the main components shown in FIG. 1, which comprise: a fuel tank 1, an evaporation plate 2 and a fuel distribution plate 3, over which the vapors are combusted, and a vapor cut-off valve. Tank 1 is equipped with a fuel inlet 5 and a venting pipe 6, which is connected with evaporation plate 2 with pipe 7. Fuel P is delivered to evaporation plate 2 via pipe 7 in a gravitational manner due to the connected vessels rule. Evaporation plate 2 has the vapor outlet 8 connected with the cut-off valve 4 and it is equipped with an external heating plate 9 with fuel inlet 10 for the furnace installation ignition. Distribution plate 3 is connected with cut-off valve 4 via inlet 11 and it has 12 holes in its upper part for the exhaust of fuel vapors.

The principle of operation of the furnace installation is shown in FIG. 1. Fuel P is poured into fuel tank 1 via fuel inlet 5 and then it flows via pipe 7 to the evaporation plate 2, whereas the fuel level marked with a dotted line 13 is considered as maximum level in order to leave free an aerial space over fuel table, as well as in order to protect fuel P against entry into the vapor outlet 8. A small amount of fuel P (5 ml to 50 ml) is poured in the ignition plate 10, and the fuel is ignited. Fuel combusted in the heating plate 9 causes fast heating of the evaporation plate 2 and fuel P, which is present in the plate. Defined volume of fuel P poured in allows heating up of the system up to a temperature allowing intensive fuel P evaporation. Under influence of the evaporation and a raised pressure, vapors are transferred into a vapor outlet 8 via the cut-off valve 4 and via the inlet 11 into the distribution plate 3, where the vapors are propagated and exhausted through the holes 12 on their whole length, where their ignition from the flame occurs within the heating plate 9 and then combustion takes place. Right after the system heating and the start of the installation operation, an amount of fuel P poured into heating plate 9 is depleted. At the same time, vapors located over the distribution plate 3 cause the plate heating. The heat is transferred via system components into the evaporation plate 2 and the fuel evaporation process is kept on a desired level. Up to the depletion of the fuel P in tank 1 and evaporation plate 2, the system is self-operated. The cut-off valve 4 can be closed in any moment, what results in the cut-off of the vapor inflow into distribution plate 3 and consequently in the flame in the flame extinguish. The cut-off valve 4 closing results in the formation of an overpressure within the evaporation plate 2 and a push-out of fuel P into fuel P tank 1, which in turn causes mixing of the heated fuel P with the cool fuel in fuel tank 1 and termination of the evaporation process, whereas the fuel P is no longer in contact with the heated elements of the evaporation plate 2. The venting system 6 is installed in the fuel tank 1, protecting the system against a pressure raise, whereas fuel tank 1 has enlarged capacity as compared to a nominal value, thus at the moment of relocation of the fuel volume from the evaporation plate 2 is not accompanied with the tanks overfilling.

An advantageous example of the furnace installation with two fuel tanks, including details, is shown in FIGS. 2 to 6. The installation is equipped with two fuel tanks—a main tank 1 and additional tank 14 enlarging volume of collected fuel P. The fuel inlet 5 is installed in the main fuel tank 1. Both fuel tanks 1 and 14 are connected with a pipe 15, through which the fuel P is poured into the second tank 14. The stub pipe 16 connected with the evaporation plate 2 is placed in the pipe 15 connecting both tanks. Both tanks are equipped with venting stub pipes 6 and 17. The tanks are located on a suitable level, assuring continuous gravitational supply of the fuel used in the evaporation plate 2. The tanks are suitably inclined in order to allow the fuel P flow. The manual pump 18 is installed at the main tank 1, near the fuel inlet 5. A protecting cover 19 should be opened in order to access fuel inlet 5 and pump 18. Pressing the pump 18 results in sucking the fuel P from the tank 1 and pressing the fuel via the stub pipe 20 into the trough-shaped heating plate 9. The wick 21 is located in the trough, which is ignited via the slot 22 in the fire grate 23. This allows ignition of the fuel P in the heating plate 9. Evaporation plate 2 is connected with the distribution plate 3 via the cut-off valve 4. The evaporated vapors are transferred into the distribution plate 3, where under the influence of a small overpressure and temperature they come out via a train of holes 12 over the distribution plate 3 where they are combusted. The principle of operation of the furnace installation shown in FIGS. 2 to 5, is analogical to that previously described in case of furnace installation with a single fuel tank 1. In case of the option with two fuel tanks 1 and 14, the fuel P is poured into the tanks 1 and 14 via the fuel inlet 5. The fuel flows into the second tank 14 via pipe 15 connecting both tanks. Via the stub pipe 16 connected with the evaporation plate, the fuel flows also into the plate. Fuel levels in all the connected vessels are the same. At the bottom side, the system is shielded with the protective cover 24 with suitable venting holes 25. The wick 21 holds up fuel combustion in the trough 9. The fuel ignited in the heating plate 9 during combustion heats up the evaporation plate 2 and the fuel contained in it. When a suitable temperature is achieved, fuel P in the evaporation plate 2 intensively evaporates. The vapors flow via the cut-off valve 4 into the distribution plate 3. The vapors distributed along the whole plate length flow up via the train of holes 12 and they are combusted over it. At the same time, the combusted vapors heat up the elements of the distribution plate 3 and the evaporation plate 2, so an additional delivery of heat energy is not needed. A metered amount of fuel introduced into the heating plate 9 is combusted and there is no need of additional fuel metering. When heated up and started, the system is self-combusted. Material, thickness of walls and volumes of heated and ignited fuel were matched in such way, that when the suitable temperature is reached, the system no longer needs additional heat sources in order to assure a stable operation of the system.

In order to stop the system operation, the cut-off valve 4 located between the evaporation plate 2 and the distribution plate, is closed. Stoppage of the vapor flow results in the flame extinguishing. At the same time, the vapors generated in the evaporation plate 2, having no way to escape, generate an overpressure over the liquid table in the evaporation plate 2. The overpressure pushes out the heated fuel into the tanks 1 and 14 where it is mixed with a cool fuel. As there is no contact with the hot walls of the evaporation plate 2, the evaporation process is rapidly stopped. In order to restart the system, the cut-off valve 4 should be opened, allowing fuel to flow into the evaporation plate (equalization of the level in connected vessels) and supply of the fuel portion into the heating plate 9, and finally the fuel ignition. When heated, the vapors are ignited by the flame of the fuel combusted in the heating plate 9. When the combustion in the heating plate 9 is stopped (heating up), the system is operated up to a moment of fuel cut-off or depletion on the fuel in the tanks 1 and 14.

An example of an electronically controlled furnace installation is shown in FIG. 6. The principle of operation is identical as in the case of the option without an electronic control with one exception, that elements responsible for the ignition, stoppage and safety, are operated automatically. A set of heaters 26 was used instead of the pump 18 and the heating plate 9. The cut-off valve 4 was replaced with an electric-valve 27. The system was equipped with additional temperature sensors 28 of the distribution plate 3 and the temperature sensor 29 of the evaporation plate 2 near the set of heaters 26. Additionally, the system was equipped with an automatic spark ignition system comprising a spark generator 30 and spark magneto electrodes 31. The device is also equipped with a set of safety sensors comprising: a movement sensor 32, disabling the furnace installation in case of overturning or relocation, a carbon oxide sensor 33 or optionally an oxygen or carbon dioxide sensor, disabling the installation in case of sensing an improper concentration of the tested gas, and a humidity sensor 34 controlling the system tightness and reacting in case of sensing a liquid presence under the tanks on the shield 24, resulting from a fuel effluent or fuel poured by the user. The fuel filler 10 is covered with a movable cover 35, protected with a switch 36, which switches off the installation and extinguishes the flame in case of its opening during the system operation. In this option, the installation is equipped with a control system 37, however the control panel 38 has the function of a communicator between the user and the control system 37, allowing readout of messages and generation of commands like: switch on, switch off, flame height control, etc. A generation of commands is possible with use of a remote control pilot 39. he control panel 38 is also equipped with suitable connections (not shown in the figure) allowing PC installation in order to load new software or regulation (setting). This solution serves for producer or authorized service. These connections allow also the connection of the installation with an intelligent house installation, including the furnace installation control from a panel of this installation.

The principle of operation of the installation of this type is following. When the fuel P is poured into the tank 1, the user closes the movable cover 35, which is protected with the switch 36, and the system cannot be switched ON before the cover is closed.

When the cover 35 is closed and the button 'start' on the control panel 38 or pilot 39 is pushed, the set of heaters 26 is enabled and the electric-valve 27 is opened. The set of heaters 26 heats the evaporation plate 2 up to a temperature of intensive fuel evaporation. The vapors are transferred via the electric-valve 27 into the distribution plate 3 and are then exhausted via the holes 12. At the moment, when the vapors reach the distribution plate 3, its temperature is raised, what is sensed by the temperature sensor 28. When the plate reaches a suitable temperature, a suitable signal is sent to the spark generator 30, and a spark is generated on the electrodes 31. The spark ignites the vapors over the distribution plate 3. The ignition of the vapors increases the temperature on the temperature sensor 29, signaling the flame ignition. If the temperature is not raised in a few seconds since the spark was generated, the sequence is repeated. If after several collapsed trials the temperature is not raised, the installation is switched OFF and the electric-valve 27 is closed. However, if the vapors were ignited and the temperature on the sensor 29 was raised, the operation is continued, and the set of heaters 26 is switched OFF. The fuel is evaporated in result of the heat transfer though the elements of the plates 2 and 3. There is an option of successive switching OFF the heaters 26, in order to raise the temperature of the evaporation plate 2 to control (raise) the flame. Because of the safety reasons, self-acting shut down, or shut down by the user intervention is also possible. A self-acting shut down takes place in several cases, i.e.: if the installation is moved, what is signalized by the sensor 32, if an improper concentration of gas in the air is detected by the sensor 33, if the fuel in the fuel tanks 1 and 14 is depleted and the temperature 29 is raised on the evaporation plate 2, or if the set of heaters 26 is activated without the fuel and the temperature is raised above a permissible temperature on the temperature sensor 29 located on the evaporation plate 2, and also if the movable cover 35 protecting access to the fuel inlet 5 is open, which is detected by switch 36 or if the diagnostic system detects a defect of any sensor. In each of the mentioned cases, the electro-valve 27 is closed, the installation is shut down, and a suitable message is displayed on a control panel 38.

However, a new combustion mode used in a furnace installation is schematically shown in FIG. 7. After filling up a fuel tank 111, the liquid fuel from the tank 111 is transferred via the pipe 121 into the heating chamber 131. The fuel is heated in the chamber up to a temperature of 60-75°, optimally with the use of an electric heating element 141, which generates the vapors. Under the influence of the generated pressure, the vapors are transferred via the pipe 151 into the combustion zone 161, defined by the surface 171 of the distribution chamber 181. It has a form of a pipe with numerous shaped holes 191, from which the vapors exhausted from the combustion chamber 181 are combusted in result of electric spark formation, forming the flame. The flame is controlled by a raised heating chamber 131 pressure, in result of a heating time regulation of a built-in heating element 141, or in result of a power regulation of the heating element 141, which is electrically energized vie the cable 171.

The described furnace installation and its principle of operation, according to essential features of the invention, does not comprise all possible realization types. These detailed descriptions of advantageous options should not be interpreted as limiting the basic innovative idea described in the main part of the present description.

The invention claimed is:

1. A liquid fuel-fired furnace installation comprising
a fuel tank(1);
a fuel evaporation plate (2);
a fuel vapor distribution plate (3);
a pipe (7) connecting the fuel tank (1) to the evaporation plate (2);
a vapor outlet (8) furnished on the evaporation plate (2);
a vapor flow cut-off valve (4) connected to the vapor outlet (8);
an external heating plate (9) furnished at the evaporation plate (2);
a fuel inlet (10) for ignition installed at the external heating plate (9);
an inlet stub pipe (11) connected to the fuel vapor distribution plate (3);
wherein the fuel vapor distribution plate (3) is connected with the inlet stub pipe (11);
shaped holes (12) disposed in an upper part of the fuel vapor distribution plate (3), wherein the fuel vapors are exhausted through the shaped holes (12);
a movable cover (35) covering the fuel inlet (10);
a switch (36) protecting the movable cover (35);
wherein the switch (36) switches off the installation and extinguishes the flame in case of the opening of the movable cover (35) during the system operation.

2. The liquid fuel-fired furnace installation according to claim 1 further comprising
a fuel inlet (5) placed on the fuel tank (1);
a venting stub pipe (6) furnished to the fuel tank (1).

3. A liquid fuel-fired furnace installation comprising
a fuel tank (1);
a fuel evaporation plate (2);
a fuel vapor distribution plate (3);
a pipe (7) connecting the fuel tank (1) to the evaporation plate (2);
a vapor outlet (8) furnished on the evaporation plate (2);
a vapor flow cut-off valve (4) connected to the vapor outlet (8);
an external heating plate (9) furnished at the evaporation plate (2):
a fuel inlet (10) for ignition installed at the external heating plate (9):
an inlet stub pipe (11) connected to the fuel vapor distribution plate (3);
wherein the fuel vapor distribution plate (3) is connected with the inlet stub pipe (11);
shaped holes (12) disposed in an upper part of the fuel vapor distribution plate (3), wherein the fuel vapors are exhausted through the shaped holes (12);
a second fuel tank (14) disposed in parallel to the first fuel tank (1);
a pipe conduit (15) connecting the second fuel tank (14) to the first fuel tank(1);
wherein the evaporation plate (2) and the distribution plate (3) are placed between the first fuel tank (1) and the second fuel tank (14);
a metering pump (18) furnished to the first tank (1) near the fuel inlet (10);
a trough-shaped heating plate (9) installed under the fuel inlet (10);
a wick (21) is located at the trough-shaped heating plate, and all mentioned subassemblies are closed in the shield (24) with ventilation slots (25).

4. A liquid fuel-fired furnace installation comprising
a fuel tank (1);
a fuel evaporation plate (2);
a fuel vapor distribution plate (3);
a pipe (7) connecting the fuel tank (1) to the evaporation plate (2);
a vapor outlet (8) furnished on the evaporation plate (2);
a vapor flow cut-off valve (4) connected to the vapor outlet (8);
an external heating plate (9) furnished at the evaporation plate (2);
a fuel inlet (10) for ignition installed at the external heating plate (9);
an inlet stub pipe (11) connected to the fuel vapor distribution plate (3);
wherein the fuel vapor distribution plate (3) is connected with the inlet stub pipe (11);
shaped holes (12) disposed in an upper part of the fuel vapor distribution plate (3), wherein the fuel vapors are exhausted through the shaped holes (12);
a set of heaters (26) installed in a furnace installation control system, replacing the heating plate (9) and an electro-valve (27) and a temperature sensor (28) of the distribution plate (3) and a temperature sensor (29) of the evaporation plate (2), as well as a system of automatic spark ignition (30, 31) and a system of safety sensors, comprising a movement sensor (32), a carbon oxide sensor (33) or optionally a carbon dioxide sensor, a humidity sensor (34), wherein a fuel inlet (5) in the first tank (1) is shielded with a movable cover (35) connected with a switch (36), shutting down the installation if the cover (35) is opened during the system operation.

5. A method of operation of a furnace installation comprising the steps: delivering fuel (P) with a pipe (7) to an evaporation plate (2) in gravitational mode according to connected vessels rule;

leaving an aerial layer over a fuel table (13); preventing fuel (P) from entering a valve stub pipe (4. 27); thereafter delivering a small amount of fuel into a fuel inlet (10) for ignition;

igniting the small amount of fuel in a heating plate (9) thereby causing fast heating of the evaporation plate (2) filled with the fuel (1);

generating fuel vapors under an influence of evaporation and raised pressure: transferring the fuel vapors into a valve stub pipe (4. 27) and via an inlet sub pipe (8) into a distribution plate (3);

propagating and exhausting the fuel vapors via shaped holes (12) on the whole plate length;

igniting the fuel vapors from the flame in the heating plate (9); causing a heating of the distribution plate (3) after fuel depletion in the heating plate (9) by the fuel vapors combusted over the distribution plate (3);

transferring the heat of the distribution plate (3) onto the evaporation plate (2); keeping a fuel evaporation process and a combustion on a targeted level in a self-acting manner until the fuel in tank (1) is depleted;

operating a pilot-operated (39) electronic control system;

allowing an automatic ignition with a spark delivered from a spark generator (30);

equipping the installation with an automatic flame extinguishing system, starting up the installation;

self-controlling the furnace installation after starting up with respect to combustion parameters;

detecting dangerous concentrations of generated gases, system leakages and improper transport/installation.

6. A method of operation of a furnace installation comprising the steps: delivering fuel (P) with a pipe (7) to an evaporation plate (2) in gravitational mode according to the connected vessels rule;

leaving an aerial layer over a fuel table (13);

preventing fuel (P) from entering a valve stub pipe (4, 27);

thereafter delivering a small amount of fuel into a fuel inlet (10) for ignition;

igniting the small amount of fuel in a heating plate (9) thereby causing fast heating of the evaporation plate (2) filled with the fuel (P);

generating fuel vapors under an influence of evaporation and raised pressure;

transferring the fuel vapors into a valve stub pipe (4, 27) and via an inlet stub pipe (8) into a distribution plate (3);

propagating and exhausting the fuel vapors via shaped holes (12) on the whole plate length;

igniting the fuel vapors from the flame in the heating plate (9); causing a heating of the distribution plate (3) after fuel depletion in the heating plate (9) by the fuel vapors combusted over the distribution plate (3);

transferring the heat of a distribution plate (3) onto the evaporation plate (2);

keeping a fuel evaporation process and a combustion on a targeted level in a self-acting manner until the fuel in tank (1) is depleted;

furnishing a system with fuel vapor combustion extinguishing, resulting from closing a valve (4, 27) effecting a fuel vapor cut-off;

closing the valve (4, 27) of the fuel vapor cut-off;

forming an overpressure within the evaporation plate (2) and a push-out of fuel (P) into the fuel (P) tank (1);

mixing of the heated fuel (P) with cool fuel in fuel tank (1);

terminating the evaporation process;

interrupting contact of the fuel (P) with the heated elements of the evaporation (2);

installing the venting system (6) in the fuel tank (1) for protecting the system against a pressure rise, wherein the fuel tank (1) has an enlarged capacity as compared to a nominal value, wherein the relocation of fuel (P) from the evaporation plate is not accompanied by an overfilling of the tank (1).

7. A method of operation of a furnace installation comprising the steps: delivering fuel (P) with a pipe (7) to an evaporation plate (2) in gravitational mode according to the connected vessels rule;

leaving an aerial layer over a fuel table (13);

preventing fuel (P) from entering a valve stub pipe (4, 27);

thereafter delivering a small amount of fuel into a fuel inlet (10) for ignition;

igniting the small amount of fuel in a heating plate (9) thereby causing fast heating of the evaporation plate (2) filled with the fuel (P);

generating fuel vapors under an influence of evaporation and raised pressure;

transferring the fuel vapors into a valve stub pipe (4, 27) and via an inlet stub pipe (8) into a distribution plate (3);

propagating and exhausting the fuel vapors via shaped holes (12) on the whole plate length;

igniting the fuel vapors from the flame in the heating plate (9); causing a heating of the distribution plate (3) after fuel depletion in the heating plate (9) by the fuel vapors combusted over the distribution plate (3);

transferring the heat of a distribution plate (3) onto the evaporation plate (2);

keeping a fuel evaporation process and a combustion on a targeted level in a self-acting manner until the fuel in tank (1) is depleted;

furnishing a system with fuel vapor combustion extinguishing, resulting from closing a valve (4, 27) effecting a fuel vapor cut-off;

closing the valve (4, 27) of the fuel vapor cut-off;

installing a second fuel tank (14) for enlarging the volume of the collected fuel (P);

installing a fuel inlet (5) in the first fuel tank;

installing a pipe (15) connecting the second tank (14) to the first tank (1) and the fuel (P) is poured into the second tank (14) through the pipe (15);

connecting the evaporation plate (2) to the pipe (15) with a stub pipe (16);

equipping the first tank with a first venting stub pipe (6);

equipping the second tank with a second venting stub pipe (17); locating the first tank at a level assuring continuous gravitational supply of the fuel (P) used;

locating the second tank at a level assuring continuous gravitational supply of the fuel (P) used;

inclining the first tank (1) for allowing flow of the fuel (P);

inclining the second tank (14) for allowing flow of the fuel (P);

installing a manual pump (18) at the first tank (1);

inclining the first tank for allowing flow of the fuel (P) near the fuel inlet (5);

opening a protective cover (19) for accessing the fuel inlet (5) and the manual pump (18);

pressing the pump (18) sucks the fuel (P) from the first tank (1) and pressing the fuel into the trough-shaped heating plate (9) through the stub pipe (20);

locating a wick (21) in a trough;

igniting the wick (21) through a slot (22) in a fire grate (23) thereby allowing ignition of the fuel (P) in the heating plate (9);

connecting the evaporation plate (2) with the distribution plate (3) through the cut-off valve (4);

transferring evaporated vapors into the distribution plate (3), where the evaporated vapors come out under the influence of a small overpressure and temperature through a train of holes over the distribution plate (3), where the evaporated vapors are combusted.

* * * * *